United States Patent [19]

Shanton et al.

[11] Patent Number: 4,587,538

[45] Date of Patent: May 6, 1986

[54] RECORD MATERIAL

[75] Inventors: Kenneth J. Shanton, Beaconsfield; Farid Azizian, Marlow, both of England

[73] Assignee: The Wiggins Teape Group Limited, Hampshire, England

[21] Appl. No.: 667,888

[22] Filed: Nov. 2, 1984

[30] Foreign Application Priority Data

Nov. 3, 1983 [GB] United Kingdom ..... 8329361

[51] Int. Cl.[4] ..... B41M 5/16; B41M 5/22

[52] U.S. Cl. ..... 346/218; 346/217; 346/223; 427/151

[58] Field of Search ..... 346/218, 223, 217; 427/150, 151, 152

[56] References Cited

U.S. PATENT DOCUMENTS 4,435,003 3/1984 Fletcher ..... 427/151

*Primary Examiner*—Bruce H. Hess

*Attorney, Agent, or Firm*—Burns, Doane, Swecker & Mathis

[57] ABSTRACT

Pressure sensitive record material uses a 2,3-disubstituted-1,2,3,4-tetrahydroquinazolin-4-ones of the formula (I):

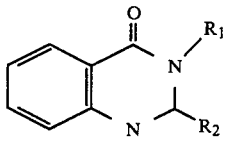

(I)

where $R_1$ and $R_2$ have defined meanings, as color formers. Preferred compounds of formula (I) are intense fade resistant and stable yellow color formers useful in making black copy formulations.

5 Claims, No Drawings

RECORD MATERIAL

This invention relates to record material, to chromogenic compositions for use in such record material, to chromogenic compounds for use in such material and compositions and to methods for making such material, compositions and compounds. In particular the invention relates to pressure sensitive sheet record material in which image formation occurs by a reaction between an electron donating chromogenic material and an electron accepting coreactant to produce a coloured species.

As is well known in the art, pressure sensitive record material typically functions by separating the colour reactive components by a pressure rupturable barrier. Most commonly this barrier is provided by microencapsulating a solution in a suitable organic solvent of one of the reactive components. On application of imaging pressure the microcapsules are ruptured, liberating the solution of one of the reactive components into reactive contact with the other component thereby forming a coloured mark or image corresponding to the applied imaging pressure. It is also known to use other forms of pressure rupturable barrier such as a dispersion of a solution in a waxy continuous layer or a honeycomb structure instead of microcapsules.

Such pressure sensitive record material can be of two basic types: the so-called "transfer" and "self-contained" types. In the transfer type the reactive components are present in coatings on facing surfaces of upper and lower sheets, the coating on the lower surface of the upper sheet comprising the isolated and usually microencapsulated solution of one reactive component and the coating on the upper surface of the lower sheet comprising the other component. Most commonly it is the electron donating chromogenic material which is present in the microcapsules in the coating on the lower surface of the upper sheet and the electron accepting coreactant is present in the coating on the upper surface of the lower sheet. This is the so-called "normal transfer" pressure sensitive system. A smaller proportion of transfer pressure sensitive record material is of the "reverse transfer" type in which it is the electron accepting coreactant which is dissolved and microencapsulated and the electron donating chromogenic material is present, usually adsorbed on a suitable particulate carrier, in the coating on the upper surface of the lower sheet.

The sheets carrying microencapsulated material on their lower surfaces are usually referred to as "CB" (coated back) sheets and the sheets carrying a reactive coating on their upper surfaces are usually referred to as "CF" (coated front) sheets. In addition it is common to use sheets which carry appropriate coatings on both upper and lower surfaces and these are usually referred to as "CFB" (coated front and back) sheets.

In self-contained pressure sensitive sheet record material, both reactive components are present on or in a single sheet. Premature reaction is almost invariably inhibited by microencapsulating one of the components, usually the electron donating chromogenic material. The reactive components can be present in one or more coatings on a surface of the sheet (coated self contained) or dispersed within the body of the sheet (loaded self contained).

A major requirement in carbonless paper is the provision of black copy images. Where the co-reactant used has at least some oxidizing properties, as in the case with acid washed bentonite clays such as those sold under the trade designations "Silton" (Mitsuzawa) and "Copisil" (Sud-Chemie), obtaining a satisfactory black image usually entails the use of several chromogenic materials of a nature and in amounts and proportions to form an initial clear black image which remains black and intense on ageing despite the fading and/or hue shift of some of its individual component chromogenic materials. In formulating such mixtures of chromogenic materials a particular difficulty exists in that there is a paucity of intense fade resistant yellows i.e. chromogenic compounds which absorb in the green-blue region of the visible spectrum in their coloured form (this description includes materials which visibly can be green, orange or neutral/black when developed on their own).

The present invention is based on the discovery that a class of substituted 1,2,3,4-tetrahydroquinazolin-4-ones behave as fade resistant chromogenic materials in pressure sensitive record material and that most of these materials are yellow and many intense yellows. This class of compounds is related to a group of 3,4-dihydroquinazolin-4-ones which are the subject of Published UK Patent Application No. 2068994 in the name of Ciba-Geigy AG. As is described in more detail below the tetrahydro-compounds of and used in the present application generally give more intense and/or more fade resistant colours than the corresponding dihydro-compounds of the Ciba-Geigy Specification, when used in pressure sensitive record material using a suitable coreactant.

The present invention accordingly provides pressure sensitive record material comprising at least one chromogenic material and at least one coreactant therefor, the chromogenic material and the coreactant being separated from each other by a pressure rupturable barrier, wherein the chromogenic material includes at least one 1,2,3,4-tetrahydroquinazolin-4-one of the general formula (I):

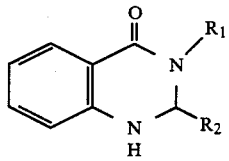

(I)

where:

$R_1$ is a hydrogen atom, an alkyl group, typically a $C_1$ to $C_{22}$, preferably a $C_6$ to $C_{18}$,alkyl or a cycloalkyl, particularly a $C_5$ or $C_6$ cycloalkyl, group, a phenyl group, a phenyl group substituted with one or more halogen, especially chlorine atoms, alkyl, especially $C_1$ to $C_4$ alkyl, groups or ether, especially $C_1$ to $C_4$ alkoxy or phenoxy groups, an aralkyl group, especially a benzyl or 1- or 2-phenylethyl group which may be ring substituted with one or more halogen, especially chlorine atoms, alkyl, especially $C_1$ to $C_4$ alkyl, groups or alkoxy, especially $C_1$ to $C_4$ alkoxy, groups, or an alkaryl group especially an alkylphenyl group in which the alkyl group is a $C_1$ to $C_{22}$, especially a $C_6$ to $C_{18}$, alkyl group; and $R_2$ is a group of one of the formulae:

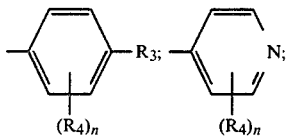

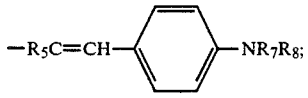

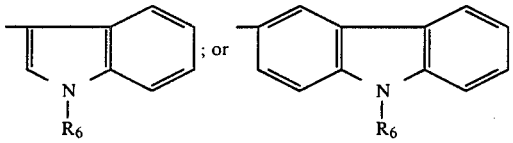

where:

$R_3$ is a group of the formula —$NR_7R_8$ or a group of the formula:

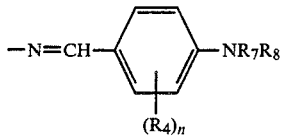

$R_4$ is a hydrogen atom, an alkyl, typically a $C_1$ to $C_{12}$ alkyl, group, an alkoxy, typically a $C_1$ to $C_{12}$ alkoxy, group, or a halogen, especially a chlorine, atom;

n is from 1 to 4, especially 1;

$R_5$ is a hydrogen or a halogen, especially chlorine, atom or an alkyl, typically a $C_1$ to $C_4$ alkyl group; $R_6$ is a hydrogen atom or an alkyl, typically a $C_1$ to $C_{12}$ especially a $C_2$ to $C_{10}$, alkyl group;

$R_7$ is an alkyl, typically a $C_1$ to $C_{12}$ alkyl group, an aryl, especially a phenyl, group or an aralkyl, especially a benzyl or phenylethyl group, or an aryl or aralkyl group substituted by one or more $C_1$ to $C_4$ alkyl or alkoxy groups and/or one or more halogen, especially chlorine, atoms; and $R_8$ is a hydrogen atom or, independently of $R_7$, is a group as defined for $R_7$; or $R_7$ and $R_8$ together with the nitrogen atom to which they are attached form a 5 or 6 membered heterocyclic ring which may include one or more other hetero atoms, as for example a 1-pyrrolidinyl, 1-piperidinyl or 1-morpholinyl group; or one of $R_7$ and $R_8$ is a hydrogen atom or a $C_1$ to $C_4$ alkyl group, and is preferably a methyl group, and the other together with the nitrogen atom to which it is bound and the 3- an 4- carbon atoms of the benzene ring form a 6 membered heterocyclic ring for example so that $R_2$ is a kaioryl group; or $R_7$, $R_8$, the nitrogen atom to which they are bound together with the benzene ring i.e. $R_2$, form a julolidinyl group.

The invention includes pressure rupturable microcapsules containing a solution of a chromogenic material in one or more organic solvent(s) wherein the chromogenic material includes at least one 1,2,3,4-tetrahydroquinazolin-4-one as defined above; a CB sheet carrying a CB coating comprising such microcapsules; and a manifold set of record material comprising such a CB sheet, a CF sheet carrying a CF coating of at least one suitable coreactant for the chromogenic material and optionally one or more intermediate CFB sheets carrying complementary CB and CF coatings. Preferably, the chromogenic material is such as to give a perceived black image on reactive contact with the colour developer.

The invention further includes compounds of the general formula II:

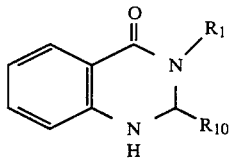

where:

$R_1$ is as defined above; and $R_{10}$ is a group of one of the formulae:

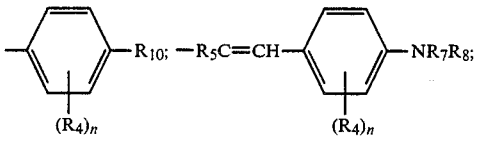

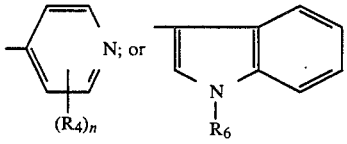

where:

$R_4$, $R_5$, $R_6$ and n are as defined above; and $R_{12}$ is a group of the formula $R_3$ as defined above or is a halogen, preferably a chlorine, atom, or a group of the formula —$NHR_{13}$ where $R_{13}$ is a hydrogen atom or an acyl, typically a $C_1$ to $C_{10}$ acyl, e.g. an acetyl, group.

Of these compounds, those where $R_{12}$ is a group of the formula $R_3$ are chromogenic compounds and those where $R_{12}$ is not a group of the formula $R_3$ are primarily important as intermediates.

The compounds used in this invention which are not of the general formula (II) above, or where $R_1$ is an unsubstituted phenyl group are generally the reduced forms of and are referred to as intermediates in the synthesis of the compounds the subject of Published UK Application No. 2068994. This prior Application does not suggest that those intermediates could be of use as chromogenic materials in their own right. A simplistic view of the chemistry of colour formation might suggest that the 1,2,3,4-tetrahydroquinazolin-4-ones used in the present invention form colour by first being oxidized to the corresponding 3,4-dihydroquinazolin-4-ones (quinazolones) and then reacting with acidic coreactant to form the corresponding colour. We do not fully understand the mechanism of colour formation of the compounds used in the present invention, but the evidence we have makes it clear that the above simple view is incorrect. Thus, for all the compounds we have comparatively tested, the UV-visible spectra of the coloured forms of the compounds used in this invention differ significantly from those of the corresponding 3,4-dihydroquinazolin-4-ones and the compounds used in this invention fade more slowly than the coloured forms of the corresponding 3,4-dihydroquinazolin-4-ones. Further, during such fading the coloured form of the compounds used in this invention generally fade with no or only small changes in hue, whereas the 3,4-dihydroquinazolin-4-ones are subject to hue shift or fading in that the absorption maximum in the region 450 to 520 nm moves to significantly longer wavelength.

From infrared and ultraviolet spectra of the coloured form of the compounds used in the invention, we believe that colour formation does not involve an overall oxidation. A comparison of the spectra of the colour developed on a CF sheet and that obtained by reaction with acids e.g. in solution shows such a close similarity that we infer that the coloured species is essentially the same in both cases. The spectral evidence is not conclusive as to the structure of this coloured species but it seems probable that for the compounds where $R_2$ is 4-dimethylaminophenyl, it is or is similar to:

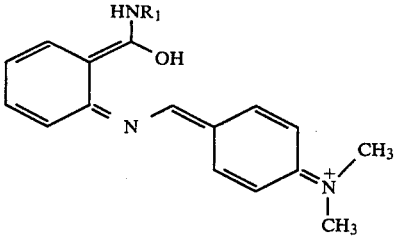

with corresponding forms where $R_2$ is other than 4-dimethylaminophenyl. Such a colour forming mechanism, giving ring opened form, accounts for the difference in colour and spectra found for the 3,4-dihydroquinazolin-4-one of UK Specification No. 2068994 as the dihydro compounds would not have this ring opening mechanism available short of oxidative clearage (which would anyway give an oxidatively degraded product).

The compounds used in this invention undergo colour forming reaction faster with strongly acidic materials than with weakly acidic materials. The reactive sites in acid washed bentonite clay coreactants are typically more strongly acidic than those present in organic coreactants such as phenolic resins and carboxylic acids such as substituted salicylic acids. For this reason the use of strongly acidic coreactants is desirable. In any event, the formation of relatively fade resistant black images on phenolic resin or salicylic CF's is somewhat easier than on the inorganic CF's of the acid clay type because the acid clays are relatively oxidizing and many colour formers fade relatively more quickly on clay CF's.

Within the general formulae given above we have found that especially advantageous results are obtained when certain substituents are used. Thus, when $R_2$ is a group of the formula:

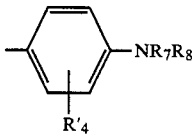

where $R_7$ and $R_8$ are as defined above but are preferably $C_1$ to $C_4$ alkyl, phenyl or benzyl groups and $R_4'$ is a chlorine atom or a $C_1$ to $C_4$ alkoxy group, preferably methoxy, and preferably $R_4$ is in the 2-position in the benzene ring, the colours produced are particularly intense and the compounds exhibit high solubility in solvents used typically in pressure sensitive record material. Solubility can also be enhanced when $R_1$ is a long chain alkyl group e.g. $C_{10}$ to $C_{20}$ especially $C_{18}$, a $C_4$ to $C_{20}$ alkylphenyl or a phenoxy phenyl group.

The compounds of and used in the present invention can be made by the method described in Published UK Application No. 2068994 or by analogy therewith. A typical such reaction sequence is outlined below:

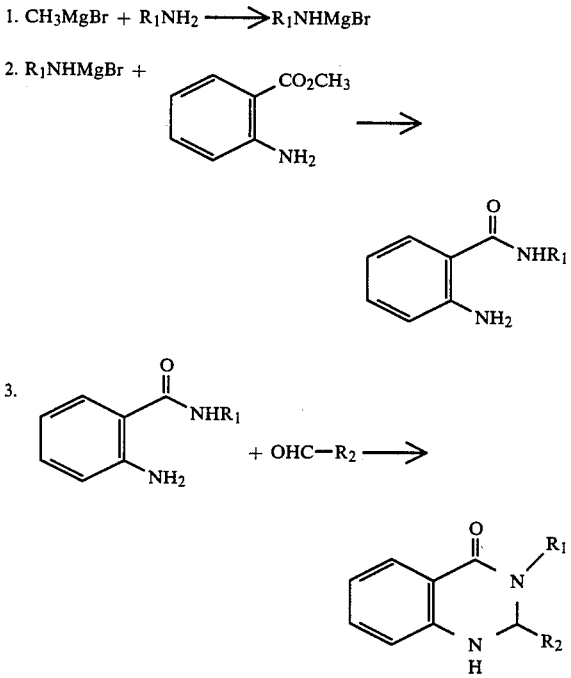

Two other possibilities for step 3. above where $R_2$ is a group of the formula:

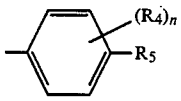

where $R_5$ is as defined above, with the exception of where $R_7$ and/or $R_8$ and the nitrogen atom of the amino group form a ring, are as follows:

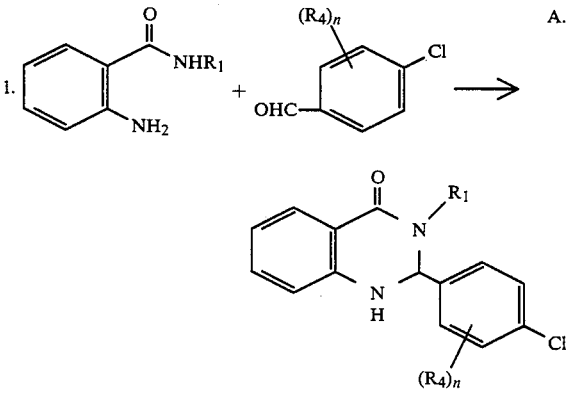

-continued

2.

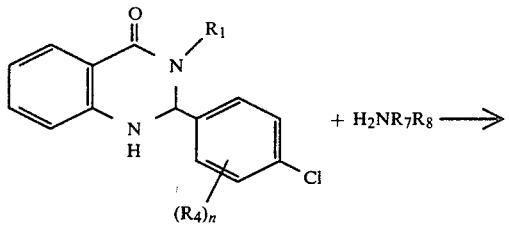

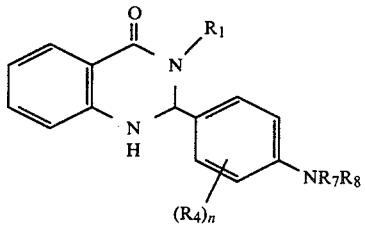

B.

1.

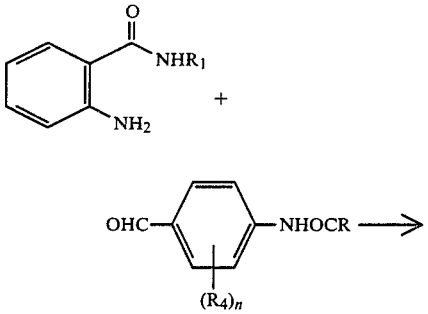

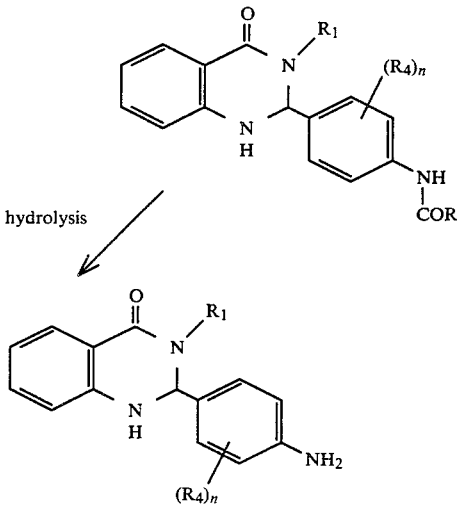

where R is an alkyl e.g. $C_1$ to $C_{12}$ especially methyl, group.

2a.

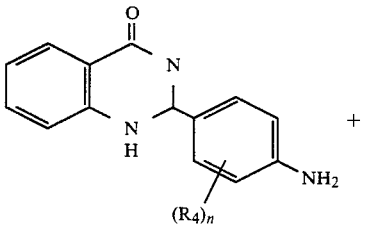

-continued

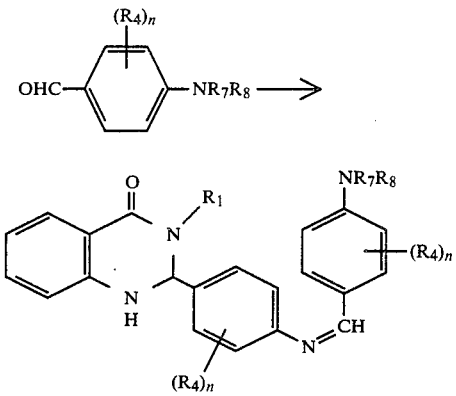

2b.

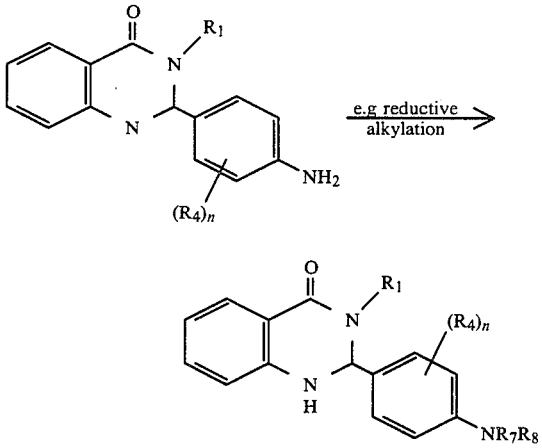

We have found that the synthesis of the intermediate aminoamide can be achieved more advantageously by the reaction of isatoic anhydride with the corresponding amine:

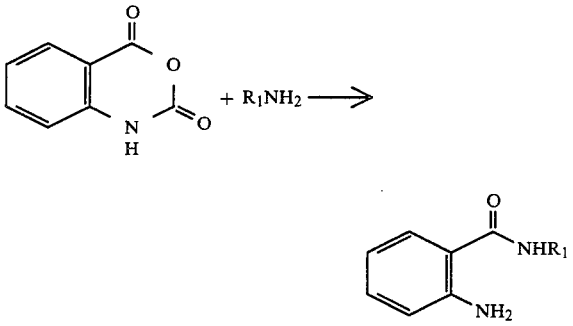

This reaction can be carried out by heating the reagents e.g. at temperatures above 100° C. especially about 120° C., and the product recovered by dissolving the reaction mixture in methanol and quenching it into water.

In the above reaction sequences $R_1$, $R_2$, $R_3$, $R_4$, $R_5$, $R_7$, $R_8$ and n are as defined above.

Most of the compounds used in the present invention produce yellow or yellow-orange images with suitable coreactants. The compounds where $R_2$ is a group of the formula:

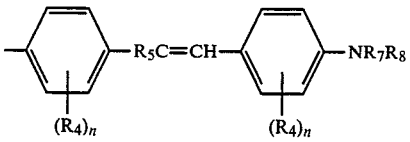

where $R_4$, $R_5$, $R_7$, $R_8$ and n are as defined above, tend to have a main absorption peak at somewhat longer wavelength and typically are reds or purples. Yellow and red image colours are not normally used in pressure sensitive record material and the main use of such chromogenic compounds is in mixtures to give images of a colour corresponding to the combination of the absorptions of the components and in particular in the production of blue and especially black or dark grey images. The invention accordingly includes a chromogenic composition which comprises a solution in an organic solvent of at least one compound of the general formula (I), above, and and at least one other electron donating chromogenic compound. Usually the other chromogenic compounds(s) will include compound(s) having coloured forms absorbing at complementary wavelengths to those of the coloured form of the compound(s) of the general formula (I) so as to produce, in combination, a perceived blue or black image.

Suitable other electron donating chromogenic compounds can be chosen from those known in the art for example, phthalides and their pyridine carboxylic acid lactone analogues, spiropyrans, especially spirodipyrans, fluorans and the leuco forms of di- and triphenylmethane dyestuffs.

The organic solvent used in the chromogenic composition can be one known for use in pressure sensitive record material. Suitable examples include alkylated benzenes, naphthalenes and biphenyls; benzylated benzenes; partially hydrogenated terphenyls; ester solvents such as phthalate and benzoate esters and phosphate esters; and long chain alcohols. Such solvents are commonly used in combination with a diluent or extender such as long chain aliphatic hydrocarbons typically kerosene ($C_9$ to $C_{14}$ alkanes).

For use in pressure sensitive record material the chromogenic compounds used in this invention will usually be microencapsulated in solution in a solvent as desribed above. The microencapsulation can be carried out by processes known in the art. Examples include complex coacervation techniques using naturally occurring colloids such as gelatin and gum arabic; a mixture of natural and synthetic colloids such as gelatin, carbomethoxy cellulose and polyvinylmethyl ether-maleic anhydride copolymer; or wholly synthetic colloidal materials; interfacial polymerization techniques; and microencapsulation by depositing a layer of polymer around a dispersed solution of chromogenic material.

The capsules can be incorporated in the sheets of pressure sensitive record material by conventional techniques. Thus, to produce CB, CFB and coated self-contained sheets the capsules can be coated onto the appropriate substrate, or the capsules can be added to the furnish of the base paper in the production of the "loaded" type of self-contained paper.

The following Examples illustrate the invention. All parts and percentages are by weight unless otherwise indicated. Spectroscopic, colour, intensity and fade tests were carried out as indicated below.

IR—a sample of the compound was dispersed in a KBr disc and the spectrum was taken on a Perkin Elmer 682 IR spectrograph. Peak positions are given in wavenumbers ($cm^{-1}$).

NMR—a sample of the compound was dissolved in $CDCl_3$ (1% w/w) and the spectrum was taken on a Perkin Elmer R-34 NMR spectrograph at 220 MHZ with tetramethylsilane as an internal standard. Peak positions are given in parts per million downfield from the internal standard.

UV-visible—samples were prepared as described below. The UV-visible reflectance spectrum was taken on a Perkin Elmer Lambda 5 spectrometer. Peak positions are given as wavelengths in nm and the relative intensities given are the ratios of the height of any particular reflectance peak in the spectrum of the unfaded sample. (NB. This measurement may be dependent on the absolute reflectance of the highest peak and would therefore be concentration and/or quantity dependent).

Colour, intensity and fade—a 1% w/w solution of the compound was prepared in 2:1 (by wt) HB40 (a partially hydrogenated terphenyl sold by Monsanto): kerosene, heating as necessary up to ca. 120° C. The solution was cooled and the solution (if necessary discarding any precipitate) was applied to "Idem" CF paper (CF paper coated with a mixture of "Silton" acid washed clay coreactant and kaolin) using a gravure roll. The resulting image was visually assessed for colour (hue) and intensity. The imnaged sample was exposed in a fade cabinet (spaced 100 watt fluorescent tubes at a distance of about 20cm from the sample) for 16 hrs, and was thereafter re-assessed for intensity by comparing it with the unfaded result. The results are given for colour as a description, for intensity on a ranking scale from 5 (most intense) to 0 (no image) and fade on a ranking scale from 10 (least fade) to 0 (image wholly faded).

EXAMPLE 1

2-(4'-dimethylaminophenyl)-3-phenyl-1,2,3,4-tetrahydroquinazolin-4-one 9.6 g (0.4 mol) Magnesium, 0.1 g iodine and 180 ml anhydrous (sodium dried) diethyl ether were placed in a 2 liter flask equipped with magnetic stirrer, condenser, dropping funnel containing 62.4 g (0.4 mol) ethyl iodide and drying ($CaCl_2$) tubes. The ethyl iodide was added dropwise slowly until the reaction started. The magnetic stirrer was then started and the remaining ethyl iodide added over a period of about ¾ hr. It was not found necessary to apply external cooling. Stirring was continued for a further ½ hr at ambient temperature to ensure completion of reaction. To the resulting solution 18.6 g (0.2 mol) of aniline were added dropwise over a period of about ½ hr. and stirring was again continued at ambient temperature for a further ½ hr. To this mixture 15.1 g (0.1 mol) methyl 2-aminobenzoate were added dropwise over a period of about ½ hr. The reaction mixture became relatively viscous (a quantity e.g. 80 ml anhydrous diethyl ether can be added to this mixture and the stirring can be supplemented by manual agitation). Stirring, or manual agitation, was continued for about one hour. A saturated aqueous solution of ammonium chloride was then added to quench the reaction, about 300 to 350 ml is usually adequate. This mixture was thoroughly stirred and the aqueous and organic phases were separated. The aqueous phase was washed with fresh diethyl ether (ca 100 ml.) and the ethereal solutions were combined, washed with water and dried over anhydrous magnesium sulphate. The intermediate, 2-amino-N-phenylbenzamide was isolated by evaporating off the ether solvent. This crude 2-amino-N-phenylbenzamide (21 g; 0.1 mol; 99% theory based on methyl 2-aminobenzoate) had a melting point of 95° C. 10.6 g (0.05 mol) of the 2-amino-N-phenylbenzamide and 7.46 g (0.05 mol) of 4-dimethylaminobenzaldehyde were heated under reflux in 100 ml ethanol for 5 hrs. The reaction mixture was allowed to cool and the product slowly crystallised out. The crystals were filtered off to give 13 g (0.038 mol; 76% theory) of a pale yellow solid. The title compound, recrystyallised from methanol, had a melting point of 195° C. The IR and NMR spectra of this purified product were taken, as described above. The compound was also imaged onto CF paper to give an intense yellow-gold colour. The UV-visible reflectance spectrum of this colouration was measured. The results of spectral analysis were as follows:

IR: 3300 ( N—H stretch ); 2800-3050 ( C—N and C—H stretch ); 1635 ( C=0 stretch ).

NMR: 2.88:6 proton singlet ( $N—CH_3)_2$ ); 4.83:1 proton singlet showing slight broadening ( N—H ); 6.5 to 7.5:13 proton complex signal (aromatic ring protons); 8.0:1 proton doublet ( C—H ).

UV: strong peak at 490 nm with a shoulder peak at 465 nm (relative intensity 0.93) and a smaller peak at 285 nm (relative intensity 0.39). After exposure in a fade cabinet for 16 hrs., as described above, the UV-visible spectrum was re-taken and the peak at 490 nm had faded to a relative intensity of 0.76 (based on the unfaded peak at 490 nm) but there was no observable shift in wavelength.

EXAMPLE 1C (COMPARISON)

2-(4'dimethylaminophenyl)-3-phenyl-3,4-dihydroquinazolin-4-one

The title compound was prepared by oxidizing a 1g sample of the corresponding substituted 1,2,3,4-tetrahydroquinazolin-4-one, prepared by the method described in Example 1, by the method described (for the corresponding 2-(4'-dimethylaminophenyl-3-methyl)-compound) in Example 1 of UK Published Application No. 2068994. The product had a melting point of 178°-80° C. This compound was imaged on CF paper, as described above, and gave a lemon yellow colouration of lower intensity than that of the compound of Example 1. The UV-visible reflectance spectrum of the coloured form of this product had a peak at 297 nm and a slightly lower peak at 428 nm (relative intensity 0.89).

After exposure in a fade cabinet for 16 hrs. as described above, the colouration had visually faded markedly.

EXAMPLE 2

2-(4'-dimethylaminophenyl)-3-benzyl-1,2,3,4-tetrahydroquinazolin-4-one

The title compound was prepared by the method of Example 1 but substituting benzylamine for the aniline used in Example 1. The melting point of the product after recrystallisation from methanol was 180° C. This compound was imaged on CF paper, as described above, and gave an intense yellow-gold colouration. The results of spectral analysis are set out below.

IR: 3600 to 3400 broad ( C—N stretch); 3310 (N—H stretch); 3100 to 2800 broad ( C—N and C—H stretch); 1670 ( C=0 stretch).

NMR: 7.0:6 proton singlet ( $—N(CH_3)_2$); 4.35:1 proton singlet ( N—H ); 5.55:2 proton complex triplet ( $—CH_2$ ); 6.4 to 7.5:13 proton complex (aromatic protons); 2.0:1 proton doublet ( C—H ).

UV-visible: Main peak at 487 nm with a shoulder at 461 nm (relative intensity 0.89) and subsidiary peaks at 361 nm (relative intensity 0.39)and 305 nm (relative intensity 0.49).

EXAMPLE 2A

2-(4'dimethylaminophenyl)-3-benzyl-1,2,3,4-tetrahydroquinazolin-4-one

The title compound was prepared by the method of Example 2 but by preparing the intermediate 2-amino-N-benzylbenzamide by the following method.

2-amino-benzylbenzamide

Isatoic anhydride (4.075 g; 0.025 mol) was placed in a 100 ml round bottom flask and benzylaminme (4.0 g; 0.0375 mol) was slowly added. During the addition heat was evolved. Subsequently the mixture was heated to about 120° C. and held for 20 minutes under stirring. The reaction mixture was cooled to about 60° C. and dissolved in 15 ml methanol. The intermediate amino amide was recovered by quenching into 500 ml water, filtration, washing with water and petroleum ether (40°-60° C.) and drying. The product had a melting point of 108°-111° C. and was obtained in a yield of 5.5 g (97% of theory). The product was pure enough to use in making the title compound without requiring further purification.

EXAMPLE 2C (COMPARISON)

2-(4'dimethylaminophenyl)-3-benzyl-3,4-dihydroquinazolin-4-one

The synthesis of Example 1C was repeated but using the benzyl-substituted 1,2,3,4-tetrahydroquinazolin-4-one instead of the phenyl-substituted compound of Example 1C. (This compound is also the product of Example 6 of Published UK Application 2068994). The product had a melting point of 140°-2° C. This compound was imaged on CF paper, as described above, and gave a pale lemon yellow colouration of lower intensity than that of the compound of Example 2. The UV-visible spectrum of this lemon yellow coloured form had a peak at 297 nm and a lower peak at 420 nm (relative intensity 0.32). On fade testing as in Example 1C, the colouration had significantly faded.

EXAMPLE 3

2-(4'-dimethylaminophenyl)-3-(4'-tolyl)-1,2,3,4-tetrahydroquinazolin-4-one

The title compound was prepared by the method of Example 1 but substituting p-toluidine for the aniline used in Example 1. The melting point of the product after recrystallisation from methanol was 214°-6° C. This compound was imaged on CF paper, as described above, and gave an intense yellow-gold colouration. The results of spectral analysis are set out below.

IR: 3600 broad ( C—N stretch); 3310 ( N—H stretch); 3100 to 2750 ( C—H stretch); 1675 (C=0 stretch).

UV-visible: Main peak at 490 nm which after fading had a relative intensity of 0.98.

EXAMPLE 3C (COMPARISON)

2-(4'dimethylaminophenyl)-3-(4'-tolyl)-3,4-dihydroquinazolin-4-one

The synthesis of Example 1C was repeated but using the (4'-tolyl)-substituted 1,2,3,4-tetrahydroquinazolin4-one instead of the phenyl-substituted compound of Example 1C. The product had a melting point of 175°-80° C. This compound was imaged on CF paper, as described above, and gave a lemon yellow colouration of lower intensity than that of the compound of Example 3. The UV-visible spectrum of this lemon yellow coloured form had peaks at 427 nm and 298 nm (relative intensity 0.98). After fading as in Example 1C, the colouration had visually faded and had a peak at 415 nm (relative intensity 0.69).

EXAMPLES 4 TO 18

Further 2-$R_2$-3-$R_1$-substituted-1,2,3,4-tetrahydroquinazolin-4-ones were made by the general synthetic route described in Example 1 by substituting $R_1$—$NH_2$ for the aniline and $R_2$—CHO for the 4-dimethylaminobenzaldehyde used in Example 1. These compounds were tested as described above and the results, together with those from Examples 1 to 3 and comparative Examples 1C to 3C, are set out in Table 1 below. It will be noted that the compounds of Examples 16 to 18 produce red to purple colourations on the CF paper.

EXAMPLE 19

2-(4'-(4''-dimethylamino)benziminophenyl)-3-phenyl-1,2,3,4-tetrahydroquinazolin-4-one (i) 2-(4'-aminophenyl)-3-phenyl-1,2,3,4-tetrahydroquinazolin-4-one 2-(4'N-acetylaminophenyl)-3-phenyl-1,.2,3,4-tetrahydroquinazolin-4-one was made by the method described in Example 1 by substituting 4-N-acetylaminobenzaldehyde for the 4-dimethylaminobenzaldehyde used in Example 1. 0.5 g (0.0014 mol) of this product was hydrolysed in a mixture of 5 ml methanol and 10 ml molar aqueous NaOH under reflux for about ½ hr. The amine separated out from the reaction mixture as a solid having a melting point of 191° C. in a yield of 0.34 g (0.0011 mol; 77% theory).

(ii) 2-(4'-(4''-dimethylamino)benziminophenyl)-3-phenyl-1,2,3,4-tetrahydroquinazolin-4-one 0.16 g (0.0005 mol) of the product from the previous stage and 0.08 g (0.0005 mol) 4-dimethylaminobenzaldehyde were mixed in a small flask, with a small quantity (ca 0.5 ml) methanol and heated on an oil bath (at 100° C.) under reflux for about ½ hr. The title compound was recovered by washing with methanol, filtering and drying to give 0.16 g (0.00036 mol; 72% theory) of product having a melting point of 162°-5° C. The compound was tested as described above and the results set out in Table 1 below.

EXAMPLE 20

2-(4'-(4''-dimethylamino)benziminophenyl)3-n-octyl-1,2,3,4-tetrahydroquinazolin-4-one This compound was made by the method described in Example 19 by substituting n-octylamine for the aniline used in Example 19. The results of testing this compound are set out in Table 1.

EXAMPLE 21

2-(4'-N-(4''-methoxyphenyl)aminophenyl)-3-phenyl-1,2,3,4-tetrahydroquinazolin-4-one 2-(4'-chlorophenyl)-3-phenyl-1,2,3,4-tetrahydroquinazoline was prepared by the method of Example 1 but substituting 4-chlorobenzaldehyde for the 4-dimethylaminobenzaldehyde used in Example 1. The crude product had a melting point of 177° C. 0.5 g (0.0015 mol)of this compound and 0.18 g (0.005 mol) p-anisidine were fused together at 120 to 140° C. for about 1 hr. The product was the title compound as a white solid having a melting point of 116° C. This compound was imaged on CF paper, as described above, and gave an intense yellow coloration. The UV-visible spectrum of the coloured form of this compound showed peaks at 416 nm and 349 nm (relative intensity 0.98).

EXAMPLES 22 TO 60

The compounds of these Examples were made by the appropriate methods described above for corresponding compounds by substituting appropriate starting materials. These compounds were tested as described above and the results are included in Table 1 below.

TABLE 1

| Ex. No. | $R_1$ | $R_2$ | M. Pt. °C. | Colour on CF | UV λ max nm | Intensity | Fade |
|---|---|---|---|---|---|---|---|
| 1 | phenyl | 4-dimethylaminophenyl | 195 | Yellow-Gold | 490 | 5 | 9 |
| 1C | phenyl | 4-dimethylaminophenyl | 178-80 | Lemon Yellow | 428 297 | 2 | 5 |
| 2 | benzyl | 4-dimethylaminophenyl | 180 | Yellow-Gold | 487 | 5 | 9 |
| 2C | benzyl | 4-dimethylaminophenyl | 140-2 | Lemon Yellow | 420 297 | 3 | 6 |
| 3 | 4-tolyl | 4-dimethylaminophenyl | 214-6 | Yellow-Gold | 490 | 5 | 9 |
| 3C | 4-tolyl | 4-dimethylaminophenyl | 175-80 | Lemon Yellow | 427 298 | 3 | 6 |
| 4 | 3-tolyl | 4-dimethylaminophenyl | 192-4 | Yellow-Gold | 491 | 5 | 8 |
| 5 | 2-phenylethyl | 4-dimethylaminophenyl | 201-4 | Yellow-Gold | 487 | 5 | 9 |
| 6 | n-octyl | 4-dimethylaminophenyl | 140 | Yellow-Gold | 485 | 4 | — |
| 7 | phenyl | 4-diethylaminophenyl | 172-5 | Yellow | — | 4 | — |
| 8 | benzyl | 4-diethylaminophenyl | 138-40 | Yellow | — | 4 | — |
| 9 | 2-phenylethyl | 4-diethylaminophenyl | 185-6 | Yellow | — | 4 | — |
| 10 | phenyl | 2-chloro-4-dimethylaminophenyl | 211-13 | Yellow-Gold | 493 | 5 | 9 |

TABLE 1-continued

| Ex. No. | $R_1$ | $R_2$ | M. Pt. °C. | Colour on CF | UV λ max nm | Intensity | Fade |
|---|---|---|---|---|---|---|---|
| 11 | benzyl | 2-chloro-4-dimethylaminophenyl | 120 | Yellow-Gold | 499 | 5 | 9 |
| 12 | 3-tolyl | 2-chloro-4-dimethylaminophenyl | 140 | Yellow | 467 | 4 | 9 |
| 13 | 4-pyridyl | 2-chloro-4-dimethylaminophenyl | 204–6 | Yellow | — | 3 | — |
| 14 | phenyl | 9-ethylcarbazol-3-yl | 255-6 | Yellow | — | 3 | — |
| 15 | 2-phenylethyl | 1-ethylindol-3-yl | 187 | Yellow | — | 2 | — |
| 16 | phenyl | 1-(4'-dimethylamino)cinnamyl | 134 | Purple | 685 578 | 5 | 9 |
| 17 | benzyl | 1-(4'-dimethylamino)cinnamyl | 151 | Purple | 722 574 | 5 | 7 |
| 18 | 2-phenylethyl | 1-(4'-dimethylamino)cinnamyl | 158–62 | Deep Pink | 724 573 | 5 | 9 |
| 19 | phenyl | 4-(4'-dimethylamino)-benziminophenyl | 162–5 | Yellow | 462 | 3 | — |
| 20 | n-octyl | 4-(4'-dimethylamino)-benziminophenyl | 47–50 | Cream | 483 | 1 | 9 |
| 21 | phenyl | 4-N—(4'-methoxyphenyl)-aminophenyl | 116 | Yellow | 416 349 | 2 | — |
| 22 | 4-methoxyphenyl | 4-dimethylaminophenyl | — | Yellow | 458 | 5 | — |
| 23 | 4-methoxyphenyl | 2-chloro-4-dimethylaminophenyl | 190–4 | Yellow-Gold | 473 | 5 | 8 |
| 24 | 4-methoxyphenyl | 4-diethylaminophenyl | 91 | Yellow-Gold | 459 | 5 | 9 |
| 25 | 3-methoxyphenyl | 4-dimethylaminophenyl | 201–3 | Yellow | 491 | 5 | 9 |
| 26 | 3-methoxyphenyl | 4-diethylaminophenyl | 168–73 | Yellow-Gold | 492 | 5 | 9 |
| 27 | cyclohexyl | 2-chloro-4-dimethylaminophenyl | 158–60 | Yellow-Gold | 489 | 5 | 9 |
| 28 | 2-tolyl | 2-methyl-4-dimethylaminophenyl | 152–5 | Yellow | 494 | 5 | 9 |
| 29 | 2-tolyl | 2-methoxy-4-dimethylaminophenyl | 103–8 | Lemon Yellow | 459 | 5 | 9 |
| 30 | 2-tolyl | 4-dimethylaminophenyl | 227 | Yellow | 488 | 5 | 8 |
| 31 | 2-tolyl | 2-chloro-4-dimethylaminophenyl | 159 | Yellow | 489 | 4 | 9 |
| 32 | 2-methoxyphenyl | 4-dimethylaminophenyl | 189–192 | Yellow | 493 | 5 | 9 |
| 33 | 2-methoxyphenyl | 2-chloro-4-dimethylaminophenyl | 195–9 | Yellow-Gold | 495 | 5 | 9 |
| 34 | 1-phenylethyl | 2-chloro-4-dimethylaminophenyl | 115–20 | Yellow-Gold | 490 | 3 | 8 |
| 35 | 1-phenylethyl | 1-(4'-dimethylamino)cinnamyl | 110–16 | Purple | 577 421 | 4 | 7 |
| 36 | benzyl | 2-methoxy-4-dimethylaminophenyl | 171–3 | Yellow | 456 | 3 | 9 |
| 37 | 4-propylphenyl | 4-dimethylaminophenyl | 206–8 | Yellow | 490 | 5 | 9 |
| 38 | 4-isopropylphenyl | 4-dimethylaminophenyl | 219–20 | Yellow-Gold | 490 | 5 | 9 |
| 39 | 4-butylphenyl | 4-dimethylaminophenyl | 197–9 | Yellow-Gold | 490 | 5 | 8 |
| 40 | 4-octylphenyl | 4-dimethylaminophenyl | 188–90 | Yellow-Gold | 491 | 5 | 8 |
| 41 | 4-dodecylphenyl | 4-dimethylaminophenyl | 163 | Yellow-Orange | 490 | 4 | 8 |
| 43 | 4-tetradecylphenyl | 2-chloro-4-dimethylaminophenyl | 120–3 | Yellow-Orange | 491 | 3 | 9 |
| 42 | 4-tetradecylphenyl | 4-dimethylaminophenyl | 183–5 | Yellow-Orange | 491 | 4 | 9 |
| 44 | 4-phenoxyphenyl | 4-dimethylaminophenyl | 167–175 | Yellow | 489 | 4 | 9 |
| 45 | 4-phenoxyphenyl | 2-chloro-4-dimethylaminophenyl | 190–200 | Yellow | 491 | 4 | 9 |
| 46 | stearyl | 4-dimethylaminophenyl | 79 | Yellow | 484 | 4 | 8 |
| 47 | stearyl | 2-methoxy-4-dimethylaminophenyl | 73–4 | Yellow | 456 | 4 | — |
| 48 | 2,4,6-trimethylphenyl | 4-dimethylaminophenyl | 250 (dec) | Yellow | 485 | 3 | 8 |
| 49 | 2,6-dimethylphenyl | 4-dimethylaminophenyl | 181–8 | Yellow-Gold | 491 | 5 | 8 |
| 50 | 2,4-dimethylphenyl | 4-dimethylaminophenyl | 242–4 | Yellow | 491 | 4 | 8 |
| 51 | 4-tolyl | 2-chloro-4-dimethylaminophenyl | 115 | Yellow-Gold | 492 | 5 | 8 |
| 52 | 2,3-dimethylphenyl | 2-methyl-4-dimethylaminophenyl | 195–8 | Yellow | 494 | 5 | 8 |
| 53 | 2,3-dimethylphenyl | 2-methoxy-4-dimethylaminophenyl | 193–5 | Lemon-Yellow | 458 | 5 | 9 |
| 54 | 2,3-dimethylphenyl | 4-dimethylaminophenyl | 254 | Yellow | 488 | 2 | 8 |
| 55 | 2,3-dimethylphenyl | 2-chloro-4-dimethylaminophenyl | 174 | Yellow Gold | 490 | 4 | 7 |
| 56 | 2-phenylethyl | 2-chloro-4-dimethylaminophenyl | 150–3 | Yellow | 489 | 5 | 9 |
| 57 | 5-chloro-2-methylphenyl | 4-dimethylaminophenyl | 250–4 | Yellow-Orange | 490 | 4 | 9 |
| 58 | 5-chloro-2-methylphenyl | 2-chloro-4-dimethylaminophenyl | 238–243 | Yellow | 494 | 4 | 9 |
| 59 | 2-methoxyphenyl | 4-diethylaminophenyl | 162–5 | Yellow Gold | 494 | 5 | 9 |
| 60 | 3-methoxyphenyl | 4-diethylaminophenyl | 168–173 | Yellow Gold | 492 | 5 | 9 |

We claim:

1. Pressure sensitive record material comprising at least a first substrate, at least one chomogenic material on said first substrate, and at least one coreactant therefor on a substrate which is either said first substrate or is a separate substrate, the chromogenic material and the coreactant being separated from each other by a pressure rupturable barrier, wherein the chromogenic material includes at least one 1,2,3,4-tetrahydroquinazolin-4-one of the general formula (I):

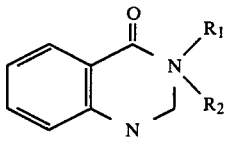

(I)

where $R_1$ is a hydrogen atom, an alkyl group, a phenyl group, a phenyl group substituted with one or more halogen atoms, alkyl groups or ether groups, an aralkyl group which may be ring substituted with one or more halogen atoms, alkyl groups or ether groups; or an alkaryl group; and $R_2$ is a group of one of the formulae:

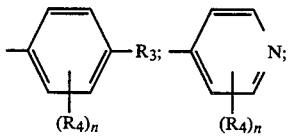

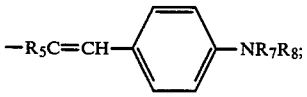

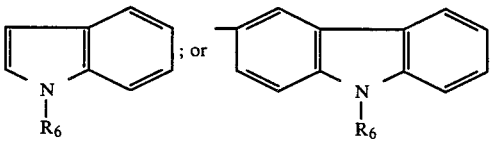

where:

$R_3$ is a group of the formula $—NR_7R_8$ or a group of the formula:

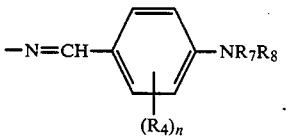

where:

$R_4$ is a hydrogen atom, an alkyl group, an alkoxy group, or a halogen atom;

n is from 1 to 4;

$R_5$ is a hydrogen or a halogen atom or an alkyl group;

$R_6$ is a hydrogen atom or an alkyl group;

$R_7$ is an alkyl group, an aryl group or an aralkyl or an aryl or aralkyl group substituted by one or more $C_1$ to $C_4$ alkyl or alkoxy groups and/or one or more halogen atoms; and $R_8$ is a hydrogen atom or, independently of $R_7$, is a group as defined for $R_7$; or $R_7$ and $R_8$ together with the nitrogen atom to which they are attached form a 5 or 6 membered heterocyclic ring which may include one or more other hetero atoms; or one of $R_7$ and $R_8$ is a hydrogen atom or a $C_1$ to $C_4$ alkyl group and the other together with the nitrogen atom to which it is bound and the 3- and 4-carbon atoms of the benzene ring form a 6 membered heterocyclic group; or $R_7$, $R_8$, and the nitrogen atom to which they are bound together with the benzene ring form a julolidinyl group.

2. Record material as claimed in claim 1 wherein, in the compound of the formula I, $R_1$ is a $C_6$ to $C_{18}$ alkyl group, a phenyl group or a phenyl group substituted with one or more chlorine atoms $C_1$ to $C_4$ alkyl groups $C_1$ to $C_4$ alkoxy groups or phenoxy groups, a benzyl or 1- or 2-phenethyl group which may be ring substituted with one or more chlorine atoms, $C_1$ to $C_4$ alkyl groups or $C_1$ to $C_4$ alkoxy groups, or an alkyl phenyl group in which the alkyl group is a $C_3$ to $C_{18}$ alkyl group.

3. Record material as claimed in claim 2 wherein in the compound of the formula I, $R_2$ is a group of the formula:

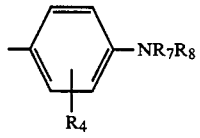

where:

$R_4$ is a hydrogen atom, a $C_1$ to $C_{12}$ alkyl group, a $C_1$ to $C_{12}$ alkoxy group or a chlorine atom; and $R_7$ and $R_8$ are each independently of each other are $C_1$ to $C_{12}$ alkyl groups, phenyl groups, benzyl groups or phenylethyl groups; or $R_7$, $R_8$ together with the nitrogen atom to which they are attached form a 1-pyrrolidinyl, a 1-piperidinyl or a 1-morpholinyl group; or $R_7$, $R_8$ the nitrogen atom to which they are attached and the benzene ring to which it is attached form a kaioryl or julolidinyl group.

4. Record material as claimed in claim 3 wherein $R_2$ is a group of the formula:

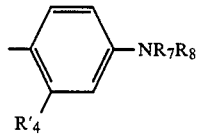

where $R_4'$ is a chlorine atom or a methoxy group; and $R_7$ and $R_8$ are each independently a $C_1$ to $C_4$ alkyl group.

5. Record material as claimed in claim 2 wherein in the compound of the formula I, $R_2$ is a group of the formula:

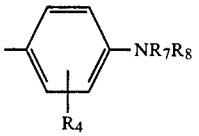

where:

$R_4$ is a hydrogen atom, a $C_1$ to $C_{12}$ alkyl group, a $C_1$ to $C_{12}$ alkoxy group or a chlorine atom; and $R_7$ and $R_8$ are each independently of each other are $C_1$ to $C_{12}$ alkyl groups, phenyl groups, benzyl groups or phenylethyl groups; or $R_7$, $R_8$ together with the nitrogen atom to which they are attached form a 1-pyrrolidinyl, a 1-piperidinyl or a 1-morpholinyl group; or $R_7$, $R_8$ the nitrogen atom to which the are attached and the benzene ring to which it is attached form a kaioryl or julolidinyl group.

* * * * *

UNITED STATES PATENT AND TRADEMARK OFFICE

CERTIFICATE OF CORRECTION

PATENT NO. : 4,587,538

DATED : May 6, 1986

INVENTOR(S) : SHANTON ET AL

It is certified that error appears in the above-identified patent and that said Letters Patent is hereby corrected as shown below:

FIRST. The general formula (I) appearing as

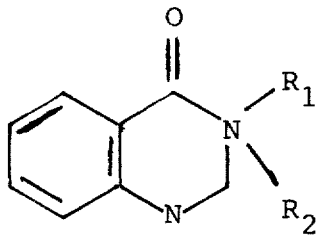

in column 17, lines 20-25 should be replaced by the following:

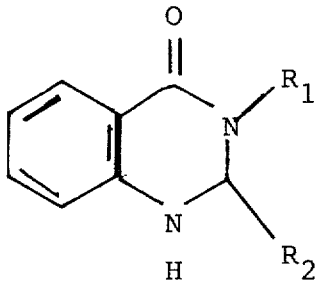

UNITED STATES PATENT AND TRADEMARK OFFICE

CERTIFICATE OF CORRECTION

PATENT NO. : 4,587,538

DATED : May 6, 1986

INVENTOR(S) : SHANTON ET AL

It is certified that error appears in the above-identified patent and that said Letters Patent is hereby corrected as shown below:

SECOND. The formula for the indolyl radical

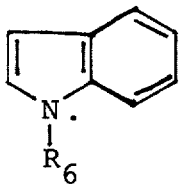

appearing in column 17, lines 45-50 should be replaced by the following:

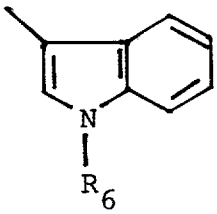

UNITED STATES PATENT AND TRADEMARK OFFICE

CERTIFICATE OF CORRECTION

PATENT NO. : 4,587,538

DATED : May 6, 1986

INVENTOR(S) : SHANTON ET AL

It is certified that error appears in the above-identified patent and that said Letters Patent is hereby corrected as shown below:

THIRD. Formula (I) shown in the Abstract on the title page should be replaced by the following:

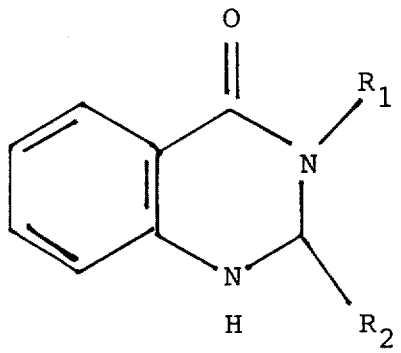

UNITED STATES PATENT AND TRADEMARK OFFICE

CERTIFICATE OF CORRECTION

PATENT NO. : 4,587,538

DATED : May 6, 1986

INVENTOR(S) : SHANTON ET AL

It is certified that error appears in the above-identified patent and that said Letters Patent is hereby corrected as shown below:

FOURTH. The first formula in the chemical equation under 2b. appearing in column 8, lines 18-27 should be replaced by the following:

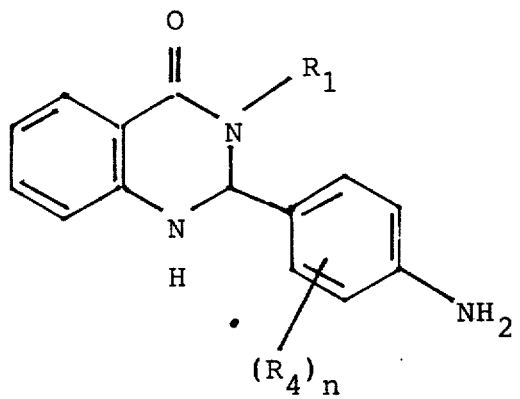

Signed and Sealed this

Twenty-eighth Day of October, 1986

[SEAL]

*Attest:*

DONALD J. QUIGG

*Attesting Officer* *Commissioner of Patents and Trademarks*